US010575569B2

(12) United States Patent
Montoya et al.

(10) Patent No.: US 10,575,569 B2
(45) Date of Patent: Mar. 3, 2020

(54) ZONED INSULATION GARMENT

(71) Applicant: NIKE, Inc., Beaverton, OR (US)

(72) Inventors: Elesban Montoya, Portland, OR (US); Raegen A. Stauffer, Portland, OR (US); Rebecca M. Sheehan, Portland, OR (US); Carmen L. Zolman, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 174 days.

(21) Appl. No.: 15/601,052

(22) Filed: May 22, 2017

(65) Prior Publication Data

US 2017/0340027 A1 Nov. 30, 2017

Related U.S. Application Data

(60) Provisional application No. 62/342,646, filed on May 27, 2016.

(51) Int. Cl.
*A41D 3/02* (2006.01)
*A41D 31/06* (2019.01)
(Continued)

(52) U.S. Cl.
CPC ..... *A41D 3/02* (2013.01); *A41D 31/06* (2019.02); *A41D 31/065* (2019.02); *D04B 1/10* (2013.01);
(Continued)

(58) Field of Classification Search
CPC ..... A41D 3/02; A41D 31/065; A41D 31/06; A41D 31/0005; A41D 31/02; A41D 31/14; A41D 31/245; A41D 31/285; A41D 31/08; A41D 31/085; A41D 13/002; A41D 2400/10; A41D 2500/10; A41D 2500/20; A41D 27/02; A41D 27/04; A41D 27/06;
(Continued)

(56) References Cited

U.S. PATENT DOCUMENTS 1,910,810 A * 5/1933 Nash ..... E04B 1/84 181/286
2,897,508 A * 8/1959 Bashore ..... A41D 13/00 2/93
(Continued)

FOREIGN PATENT DOCUMENTS

CA 2761171 C 9/2014

OTHER PUBLICATIONS

International Search Report and Written Opinion dated Sep. 19, 2017 in International Patent Application No. PCT/US2017/033945, 14 pages.
(Continued)

*Primary Examiner* — Khaled Annis
*Assistant Examiner* — Dakota Marin
(74) *Attorney, Agent, or Firm* — Shook, Hardy and Bacon LLP

(57) ABSTRACT

Aspects herein relate to a garment having zoned insulation features. The zoned insulation features comprise projections that extend in the z-direction with respect to the surface of a base material forming the garment such that the projections face toward a body surface of a wearer when the garment is worn. The number and/or size of the projections may vary over the garment depending on the amount of insulation needed in different areas of the garment.

18 Claims, 7 Drawing Sheets

(51) Int. Cl.

| | |
|---|---|
| ***D04B 1/10*** | (2006.01) |
| *A41D 27/06* | (2006.01) |
| *A41D 27/04* | (2006.01) |
| *D04B 1/12* | (2006.01) |
| *A62B 17/00* | (2006.01) |
| *A41D 31/28* | (2019.01) |
| *A41D 31/08* | (2019.01) |
| *A41D 31/14* | (2019.01) |
| *A41D 31/02* | (2019.01) |
| *A41D 31/00* | (2019.01) |
| *A41D 31/24* | (2019.01) |
| *A41D 27/02* | (2006.01) |
| *D04B 1/14* | (2006.01) |
| *A41D 13/002* | (2006.01) |

(52) U.S. Cl.
CPC ..... *A41D 13/002* (2013.01); *A41D 27/02* (2013.01); *A41D 27/04* (2013.01); *A41D 27/06* (2013.01); *A41D 31/0005* (2013.01); *A41D 31/02* (2013.01); *A41D 31/08* (2019.02); *A41D 31/085* (2019.02); *A41D 31/14* (2019.02); *A41D 31/245* (2019.02); *A41D 31/285* (2019.02); *A41D 2400/10* (2013.01); *A41D 2500/10* (2013.01); *A41D 2500/20* (2013.01); *A62B 17/00* (2013.01); *D04B 1/123* (2013.01); *D04B 1/126* (2013.01); *D04B 1/14* (2013.01)

(58) Field of Classification Search
CPC ..... A62B 17/00; D04B 1/10; D04B 1/123; D04B 1/126; D04B 1/14
USPC ..... 2/7, 5, 81
See application file for complete search history.

(56) References Cited

U.S. PATENT DOCUMENTS 3,404,406 A * 10/1968 Balliet ..... B63C 11/02 2/2.16
3,577,305 A * 5/1971 Hines et al. ..... A41D 13/0155 428/72
3,771,170 A * 11/1973 Leon ..... A41D 13/0155 2/97
4,810,559 A * 3/1989 Fortier ..... A41D 13/0156 428/161
5,413,837 A * 5/1995 Rock ..... A41D 31/02 428/192
5,466,515 A * 11/1995 Blauer ..... A41D 19/0006 442/261
5,514,459 A * 5/1996 Blauer ..... A41D 19/0006 428/304.4
5,626,949 A * 5/1997 Blauer ..... A41D 19/0006 428/195.1
6,519,781 B1 * 2/2003 Berns ..... A41D 13/0153 2/267
6,777,356 B2 * 8/2004 Sadato ..... A41D 31/02 442/76
6,962,739 B1 * 11/2005 Kim ..... B32B 3/08 428/47
6,969,548 B1 * 11/2005 Goldfine ..... B29C 44/1214 428/159
7,428,772 B2 9/2008 Rock
7,560,399 B2 * 7/2009 Rock ..... A41D 3/005 442/76
7,676,855 B2 * 3/2010 Dunn ..... B32B 3/30 2/458
8,108,949 B2 * 2/2012 Iwashita ..... B32B 27/12 2/272
8,187,984 B2 * 5/2012 Rock ..... D06M 15/263 442/64
8,424,119 B2 * 4/2013 Blackford ..... A43B 1/00 2/456
8,429,764 B2 * 4/2013 Riccelli ..... B32B 5/06 2/93
8,808,489 B2 * 8/2014 Taylor ..... B32B 38/0004 156/257
9,332,792 B2 * 5/2016 Harber ..... A41D 13/002
9,924,747 B2 * 3/2018 White ..... A41D 1/00
2002/0106953 A1 * 8/2002 Kim ..... B32B 3/08 442/71
2004/0019950 A1 * 2/2004 Rast ..... A41D 13/0158 2/77
2004/0033743 A1 * 2/2004 Worley ..... D06M 23/02 442/59
2004/0192133 A1 * 9/2004 Kim ..... B32B 3/08 442/148
2005/0009429 A1 * 1/2005 Park ..... B32B 3/12 442/181
2006/0068155 A1 3/2006 Rock et al.
2006/0080754 A1 * 4/2006 Baron ..... A41D 13/002 2/85
2006/0277950 A1 * 12/2006 Rock ..... A41D 13/002 66/169 R
2007/0022510 A1 * 2/2007 Chapuis ..... A61F 13/143 2/69
2007/0094762 A1 * 5/2007 Carter ..... A41D 15/005 2/69
2008/0057809 A1 * 3/2008 Rock ..... D03D 15/0027 442/64
2008/0113143 A1 * 5/2008 Taylor ..... A63B 71/08 428/47
2008/0206526 A1 * 8/2008 Kim ..... B32B 3/14 428/195.1
2008/0282455 A1 * 11/2008 Jones ..... A41D 31/085 2/458
2010/0015373 A1 * 1/2010 Lin ..... B32B 7/02 428/36.1
2010/0065873 A1 * 3/2010 Bhattacharya ..... A41D 27/085 257/98
2010/0293703 A1 * 11/2010 Tezartes-Strauss ..... A41D 13/0153 2/455
2011/0083246 A1 * 4/2011 Vitarana ..... A41D 13/0015 2/69
2011/0203783 A1 * 8/2011 Blackford ..... A43B 1/00 165/185
2011/0302686 A1 * 12/2011 Chapuis ..... A41D 13/0015 2/69
2013/0078415 A1 * 3/2013 Rock ..... D04B 1/00 428/96
2013/0230688 A1 * 9/2013 Wu ..... F16L 59/02 428/116
2014/0106138 A1 * 4/2014 Chung ..... A41D 31/02 428/196
2015/0366281 A1 * 12/2015 Miller ..... B32B 27/12 428/136

OTHER PUBLICATIONS

International Preliminary Report on Patentability dated Dec. 6, 2018 in International Patent Application No. PCT/US2017/033945, 8 pages.
Examiner's Report dated Sep. 5, 2019 in Canadian Patent Application No. 3,023,528, 5 pages.

* cited by examiner

ZONED INSULATION GARMENT

CROSS-REFERENCE TO RELATED APPLICATIONS

This application having U.S. application Ser. No. 15/601,052, filed May 22, 2017, and entitled "Zoned Insulation Garment" claims the benefit of priority to U.S. Prov. App. No. 62/342,646, filed May 27, 2016 and entitled "Zoned Insulation Garment." The entirety of the aforementioned application is incorporated by reference herein.

TECHNICAL FIELD

The present disclosure relates to a garment having zoned insulation features.

BACKGROUND

Garments configured for cold weather typically use some type of insulation to provide warmth to the wearer. The insulation is generally uniformly dispersed over the garment. However, since different areas of the wearer's body may produce greater heat than other areas, especially during athletic activities, this configuration may not always prove to be comfortable for the wearer.

BRIEF DESCRIPTION OF THE DRAWINGS

Examples of the present invention are described in detail below with reference to the attached drawings figures, wherein.

DETAILED DESCRIPTION

Figure 1:
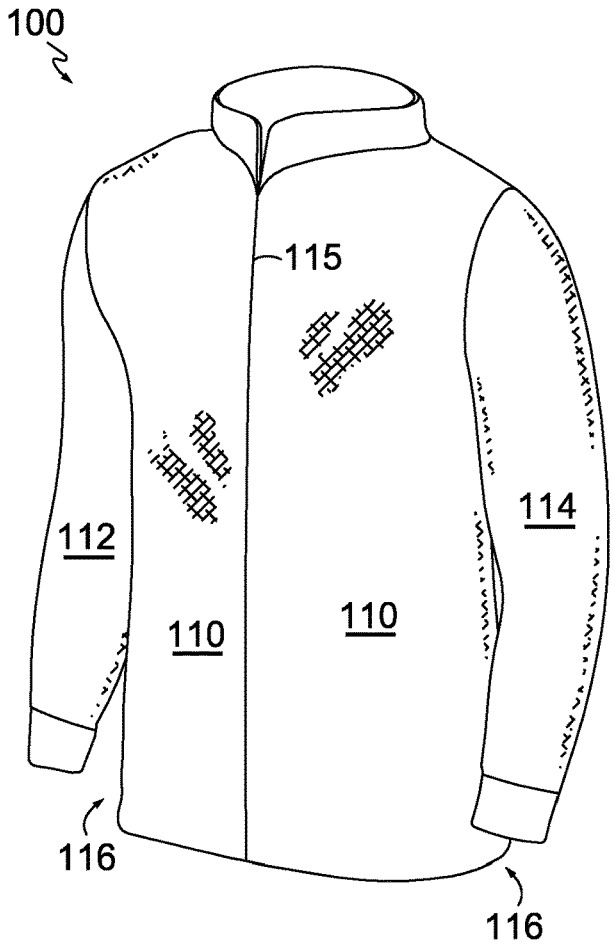
FIG. 1 illustrates a front view of an exemplary zoned insulation garment in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein relate to a garment having zoned insulation features. For example, when the garment is configured as a jacket/coat or shirt, a higher degree of insulation may be provided at the front of the garment, the side areas of the garment, and/or the sleeves of the garment, while a lesser degree of insulation may be provided at the central back area of the garment. This configuration reflects that the back area of a wearer is typically a high heat-producing area especially during exercise, while the front, sides and/or arms of the wearer may not generate as much heat during athletic activities.

In exemplary aspects, the garment may be formed from at least a base material. In exemplary aspects, zoned insulation features may be provided by utilizing different yarn and/or fiber types to form the base material and/or any projections extending therefrom as explained below. For instance, an exemplary yarn type may comprise yarns having a hollow core that help to trap warmed air. Another exemplary yarn type may incorporate a far infra-red (FIR) fiber that emits a wavelength of a predetermined length that helps to heat the human body. Yet another exemplary yarn type may comprise insulating yarns such as, for example, wool yarns. Yarns such as these may be dropped in where needed to create a zoned garment having, for instance, moderate to high insulation areas (e.g., front, sides, and/or arm portions) where the yarns described above may be used, and low insulation areas (e.g., central back area) where the yarns may not be used or are used to a lesser degree than in the high insulation areas.

Besides using different yarn types to achieve zoned insulation, the yarns may be mechanically manipulated to achieve zoned insulation features. For instance, some or all of the yarns forming the base material may be mechanically manipulated to create different types of projections that extend away from a surface of the base material (i.e., extend in the z-direction) such that they face inwardly or toward a body surface of a wearer when the garment is worn. In one aspect, the projections may have terminal ends located opposite the base material where the terminal ends may come into contact or near contact with the wearer's body when the garment is worn. The projections may be arranged in a tessellation pattern that maximizes the number of projections per unit area. Spaces may be formed between adjacent projections. In exemplary aspects, the surface area of the projections with their terminal ends may be greater than the surface area of the spaces that are formed between the projections. This configuration helps to maintain heated air produced by the wearer in contact with the wearer's body. In other words, the configuration may help to "trap" heated air and may reduce opportunities for the heated air to be channeled away from the wearer's body. The garment may be configured such that these projections are positioned in areas of the garment where a moderate to high amount of insulation is needed such as the front and sides of a shirt or jacket, and/or the sleeves of the shirt or jacket.

In another example, some or all of the yarns forming the base material may be mechanically manipulated to create projections that extend inwardly away from the surface of the base material (i.e., extend in the z-direction) and terminate in one or more edges. In other words, the projections do not comprise terminal ends as described above. The edges may be interconnected to form a honeycomb lattice of spaces. With respect to this aspect, the surface area of the projections may be less than the surface area of the spaces formed between the interconnected edges. This "open" configuration increases the chances of air movement, thus helping to cool the wearer. Moreover, the stand-off produced by the projections may help to reduce the perception of cling when the garment is worn. The projections as described may be positioned at areas of the garment where a lower amount of insulation is needed such as the central back area of the garment. When worn, this area is positioned adjacent to the back of the wearer which is typically a high heat-producing area during athletic activities.

Accordingly, aspects herein are directed to a zoned garment comprising at least a first garment portion formed from at least a base material having a first surface and an opposite second surface, wherein a first plurality of projections extend from the first surface of the base material, each of the first plurality of projections having terminal ends located opposite the base material. The zoned garment further comprises a second garment portion formed from at least the base material, wherein a second plurality of projections extend from the first surface of the base material, each of the second plurality of projections having terminal ends located opposite the base material, wherein the terminal ends of the each of the first plurality of projections have a greater surface area than the terminal ends of the each of the second plurality of projections.

In another aspect, a zoned garment is provided comprising a first garment portion formed from at least a base material having a first surface and an opposite second surface, wherein a first plurality of projections extend from the first surface of the base material, each of the first plurality of projections having terminal ends located opposite the base material. The garment further comprises a second garment portion formed from at least the base material, wherein a second plurality of projections extend from the first surface of the base material, each of the second plurality of projections having terminal ends located opposite the base material, wherein the terminal ends of the each of the first plurality of projections have a greater surface area than the terminal ends of the each of the second plurality of projections. As well, the zoned garment comprises a third garment portion formed from at least the base material, wherein a third plurality of projections extend from the first surface of the base material, each of the third plurality of projections terminating in one or more edges.

In yet another aspect, a zoned garment is provided comprising a first garment portion formed from at least a base material having a first surface and an opposite second surface, wherein a first plurality of projections extend from the first surface of the base material, each of the first plurality of projections having terminal ends located opposite the base material. The zoned garment additionally comprises a second garment portion formed from at least the base material, wherein a second plurality of projections extend from the first surface of the base material, each of the second plurality of projections terminating in one or more interconnected edges, wherein a surface area of the first plurality of projections with their respective terminal ends is greater than a surface area of the second plurality of projections.

As used throughout this disclosure, positional terms such as "anterior," "posterior," "lateral," "medial," "superior," "inferior," and the like are to be given their common anatomical meaning with respect to a hypothetical wearer wearing the zoned insulation garment while standing in anatomical position. Further, as used throughout this disclosure, terms such as affixed or secured may comprise releasably affixing materials together using, for instance, hook-and-loop fasteners, zippers, buttons, snaps, releasable adhesives and the like. These terms may also comprise permanently affixing materials together using, for example, bonding, stitching, welding, adhesives, and the like. Further, the phrase "configured to cover a [specified body portion] of wearer is to be construed with respect to a garment that is appropriately sized for the particular wearer.

Figure 2:
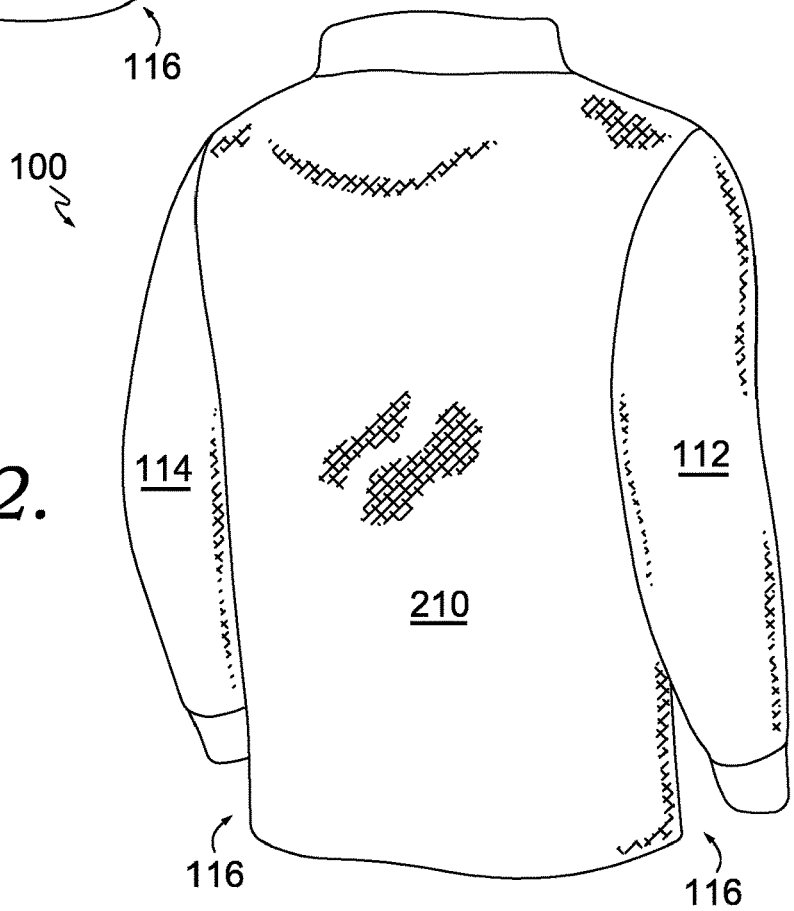
FIG. 2 illustrates a back view of the exemplary zoned insulation garment of FIG. 1 in accordance with aspects herein.

Turning now to FIGS. 1 and 2, front and back views respectively of an exemplary zoned insulation garment 100 are provided in accordance with aspects herein. Although shown as a garment for an upper torso of a wearer, it is contemplated herein that the garment 100 may be in the form of a garment for a lower torso of a wearer (e.g., a pant, a short, a legging, a capri, and the like), or the garment 100 may take the form of a sock, a hat, and the like. Any and all aspects, and any variation thereof, are contemplated as being within the scope herein. Moreover, although the garment 100 in FIGS. 1 and 2 is shown in the form of a jacket, it is contemplated herein that the zoned garment 100 may be in the form of a shirt (pullover, hoodie, sweatshirt, and the like), a coat, and/or it may comprise a liner layer adapted to be worn under an external shell layer or an external shell layer adapted to be worn over a liner layer. As well, although not shown, the garment 100 may comprise an optional hood portion having zoned insulation features. This aspect will be discussed with respect to FIG. 11. Any and all aspects, and any variation thereof, are contemplated as being within the scope herein.

With respect to FIG. 1, the zoned garment 100 comprises at least a front portion 110 adapted to be positioned adjacent to a front torso area of a wearer when the garment 100 is worn, and a first and second sleeve portion 112 and 114 adapted to be positioned adjacent to the wearer's arms when the garment 100 is worn. The garment 100 further comprises side portions 116 configured to be positioned adjacent to the side areas of the wearer when the garment 100 is worn. The side portions 116, in one exemplary aspect, may extend from an inferior margin of the sleeve portions 112 and 114 to near or at the inferior margin of the garment 100. The garment 100 is shown with an optional releasable closure mechanism 115 (such as a zipper) that can be used to open and close the garment 100 for donning and doffing. When in the form of a shirt, the releasable closure mechanism 115 may not be utilized.

With respect to FIG. 2, the garment 100 further comprises a back portion 210 adapted to be positioned adjacent to a back torso area of the wearer when the garment 100 is worn. In exemplary aspects, the front portion 110, the back portion 210, and/or the sleeve portions 112 and 114 may be formed from separate panels that are affixed together to form the garment 100. In other aspects, the front portion 110, the back portion 210, and/or the sleeve portions 112 and 114 may be formed from a seamless construction utilizing, for example, a flat knitting process, a circular knitting process, any suitable weft-knitting process or warp-knitting process, a weaving process, and the like. Continuing, the side portions 116 may comprise integral extensions of the front portion 110 and/or the back portion 210, or the side portions 116 may comprise separate panels interposed between the front and back portions 110 and 210. Any and all aspects and any variation thereof, are contemplated as being within aspects hereof.

Figure 3:
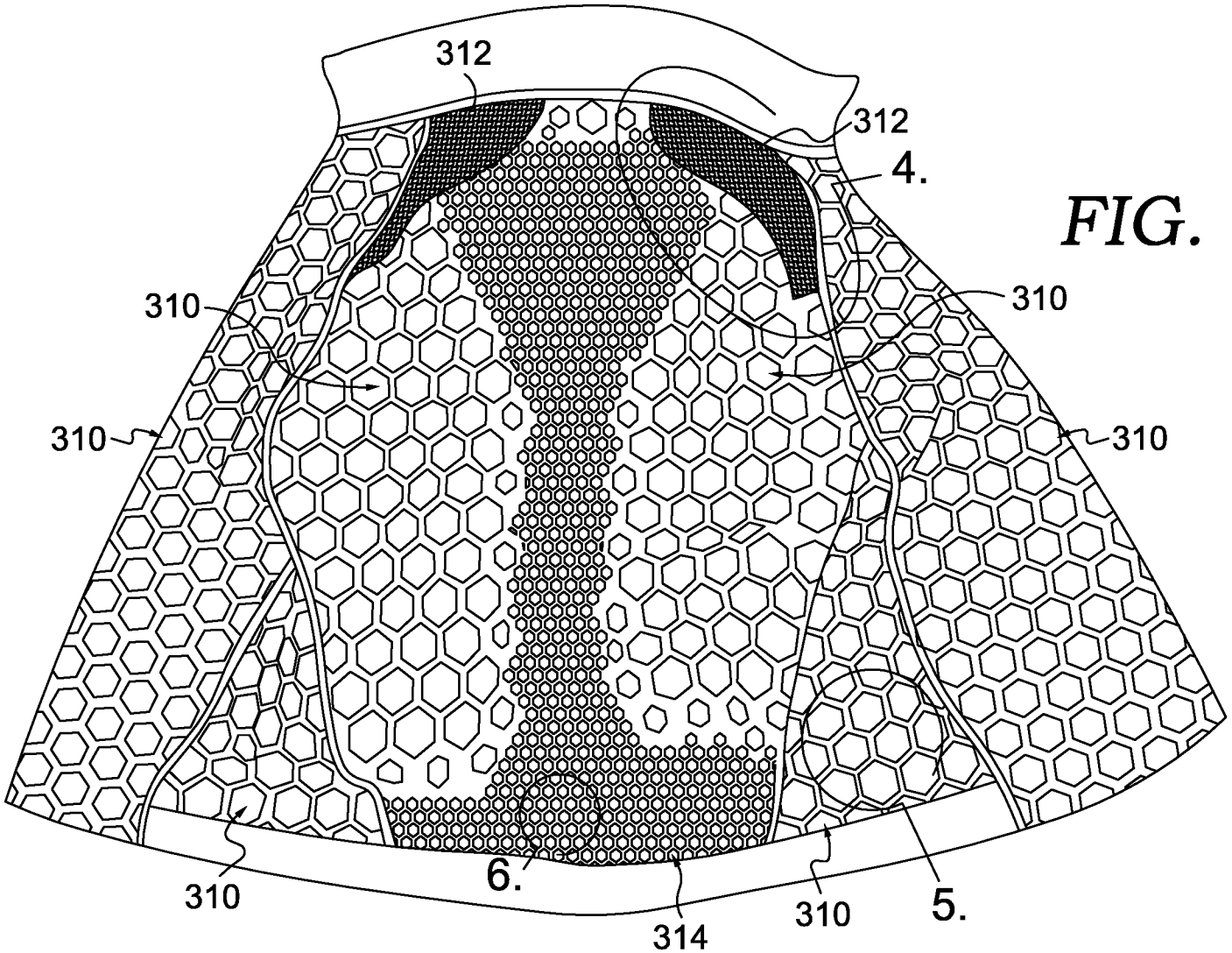
FIG. 3 illustrates the exemplary zoned insulation garment of FIG. 1 in an open state such that the interior of the garment is shown in accordance with aspects herein.

FIG. 3 illustrates a front view of the zoned garment 100 with the garment 100 in an open state such that the interior of the garment 100 is shown in accordance with aspects herein. The garment 100 may comprise a number of different garment portions with each garment portion comprising a different insulation feature. Although described as different portions, this is not meant to imply that the portions comprise separate panel pieces (although this configuration is possible). Instead, it is meant to convey that the portions may comprise different functional insulation features.

Figure 4:
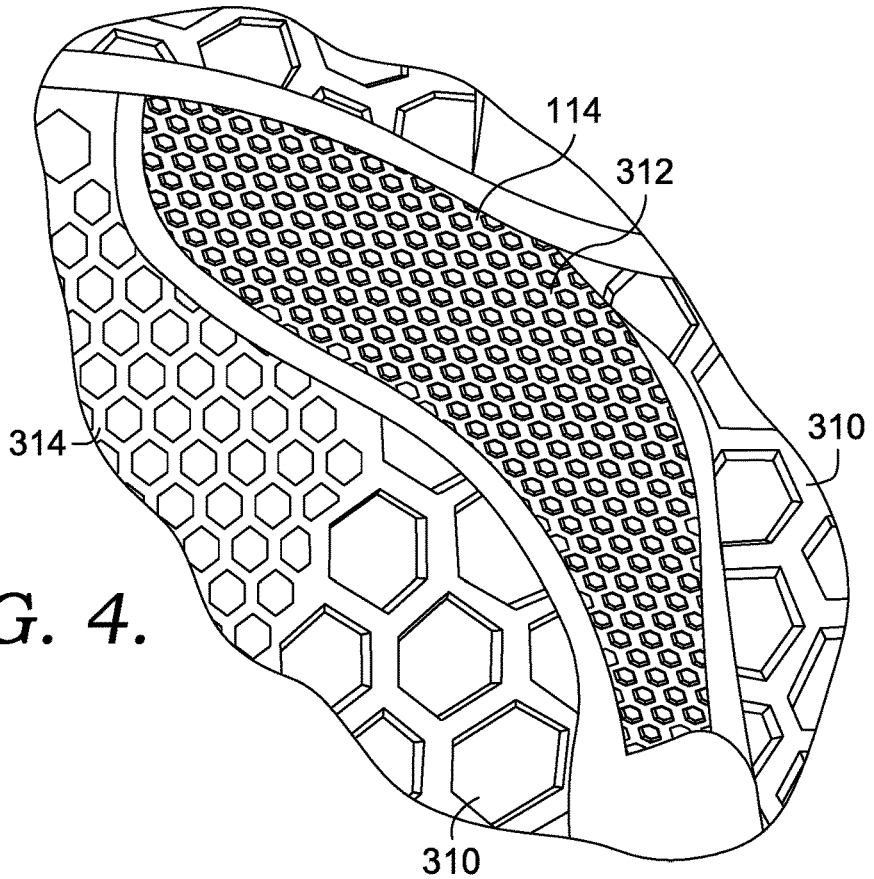
FIG. 4 illustrates an additional view of a sleeve portion of the zoned insulation garment of FIG. 3 in accordance with aspects herein.

In exemplary aspects, the garment 100 may comprise a first garment portion 310, where the first garment portion 310 generally forms the front portion 110 of the zoned garment 100, the side portions 116 of the garment 100, and lateral aspects of the back portion 210 of the garment 100. The garment 100 may further comprise a second garment portion 312, where the second garment portion 312 generally forms the first and second sleeve portions 112 and 114 of the garment 100. This is better shown in FIG. 4 which depicts a close-up view of the interior of the sleeve portion 114. Continuing, the garment 100 also may comprise a third garment portion 314 that generally extends along a center back portion of the garment 100 from, for instance, a neckline of the garment 100 to an inferior margin of the garment 100. Additional garment portions beyond those shown are contemplated as being within the scope herein. Further, the locations of the first, second, and third garments portions 310, 312, and 314 are exemplary only. For instance, although the second garment portion 312 is described as forming the first and second sleeve portions 112 and 114, it is contemplated herein that the second garment portion 312 may form just a portion of the first and second sleeve portions 112 and 114 or the entirety of the sleeve portions 112 and 114. In another example, the second garment portion 312 may help to form the front portion 110 and/or side portions 116 of the garment 100, or the first garment portion 310 may help to form the first and second sleeve portions 112 and 114. Further, it is contemplated herein that some areas of the garment 100 may not comprise functional insulation features. Any and all aspects, and any variation thereof, are contemplated as being within aspects herein.

Each of the first, second, and third garment portions 310, 312, and 314 may comprise different types of projections that extend inwardly from a surface plane of the material used to form at least the interior of the garment 100. As used throughout this disclosure, the material used to form at least the interior of the garment 100 may be known as the base material. The different types of projections will be described below.

Figure 5:
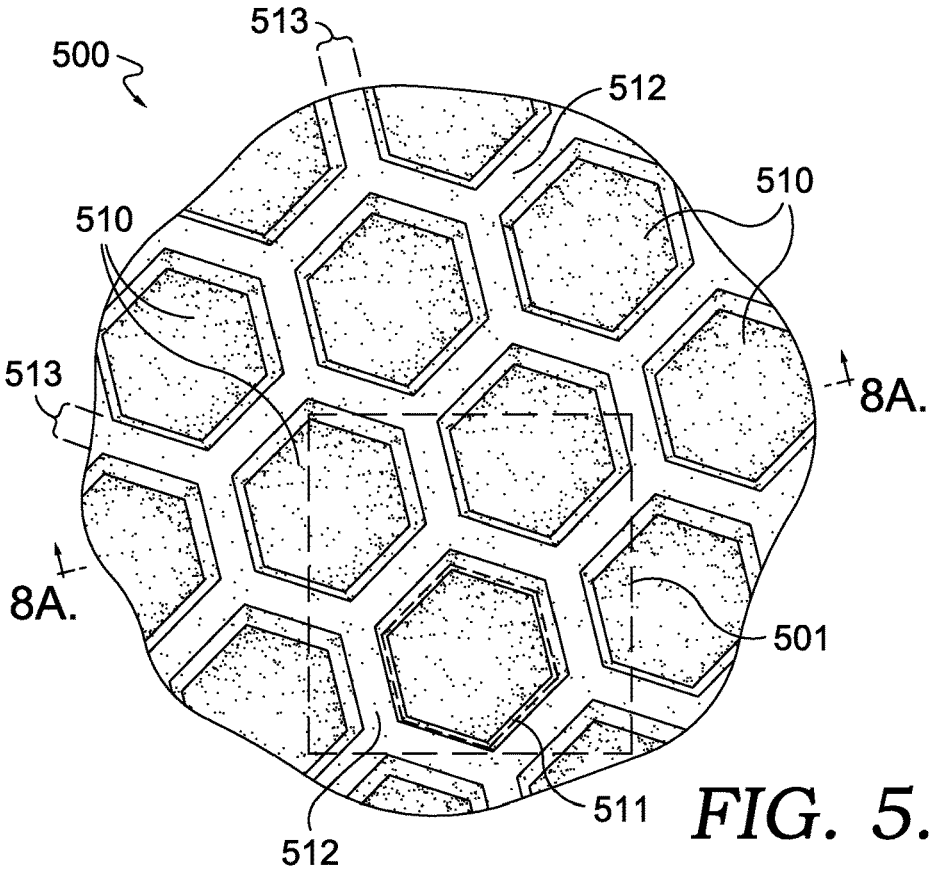
FIG. 5 illustrates a close-up perspective view of a first set of projections in accordance with aspects herein.

FIG. 5, referenced generally by the numeral 500, depicts a close-up perspective view of projections 510 utilized in, for instance, the first garment portion 310 taken at the area indicated in FIG. 3 in accordance with aspects herein. In exemplary aspects, the projections 510 extend in the z-direction with respect to the surface plane of the base material (indicated by the reference numeral 512), and each projection 510 may terminate in a terminal end 511 to form a node-like structure. This is better shown in a cross-sectional view such as that shown in FIG. 8A.

Figure 8B:
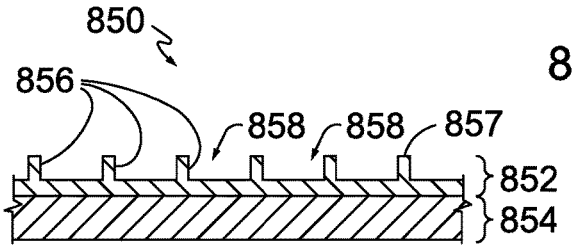
FIG. 8B illustrates a cross-sectional view taken along cut line 8B-8B of FIG. 7 accordance with aspects herein.
Figure 8A:
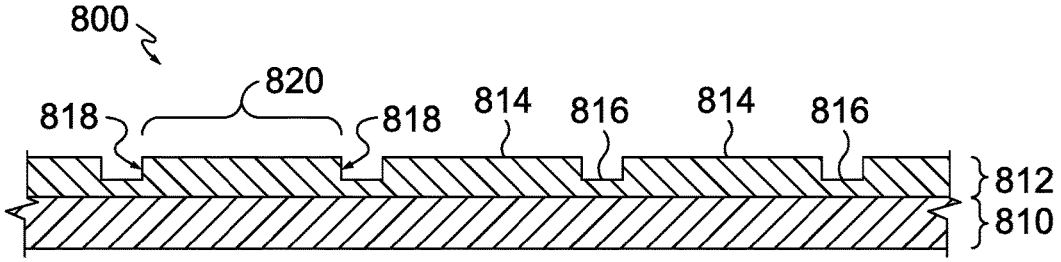
FIG. 8A illustrates a cross-sectional view taken along cut line 8A-8A of FIG. 5 in accordance with aspects herein.

FIG. 8A, referenced generally by the numeral 800 depicts at least a base material 812 from which a plurality of projections 814 extend. Each projection 814 comprises side portions 818 and a terminal end 820 located opposite the base material 812. In exemplary aspects, the side portions 818 may be substantially perpendicular to the surface plane of the base material 812 such that the terminal ends 820 of the projections 814 have a surface area that is similar to the surface area of the base of the projections 814. In another aspect, the side portions 818 may be angled such that the terminal ends 820 of the projections 814 have a smaller surface area than the surface area of the base of the projections 814. In yet another aspect, the side portions 818 may be angled with respect to the surface plane of the base material 812 such that the terminal ends 820 of the projections 814 have a greater surface area than the surface area of the base of the projections 814. Any and all aspects, and any variation thereof, are contemplated as being within the scope herein.

Returning to FIG. 5, as shown, the projections 510 may be located adjacent to each other in a tessellation pattern. Utilizing such a pattern may help to maximize the number of projections 510 per unit area of the base material 512 such as unit area 501. Although shown as having a hexagonal shape, it is contemplated herein that the projections 510 may assume different shapes such as squares, rectangles, triangles, circles, ovals, diamonds, and other known geometric shapes. Continuing, each projection 510 may have an approximate diameter (measured from one side of the terminal end 511 to an opposing side of the terminal end 511) between, for instance, 15 mm and 50 mm, 20 mm and 40 mm, and/or between 25 mm and 35 mm although diameters above and below these ranges are contemplated herein. Each projection 510 may be separated from adjacent projections 510 by a space 513. The width of the spaces 513 between adjacent projections 510 may be between, for instance, 3 mm and 15 mm, 4 mm and 13 mm, and/or between 5 mm and 12 mm, although widths above and below these ranges are contemplated herein.

In exemplary aspects, the spaces 513 between adjacent projections 510 may act as hinge points or flexion points allowing, for instance, adjacent projections 510 to flex toward one another or away from one another during movement of the garment 100 thereby increasing the pliability and/or drape of the garment 100. Moreover, the spaces 513 may act as conduits for air movement when the garment 100 is worn. In other words, air may travel through the spaces 513 thereby providing a degree of ventilation to the first garment portion 310 and improving wearer comfort. Thus, use of the projections 510 in combination with the spaces 513 between the projections 510 help to create a flexible garment that provides insulation to the wearer when the garment 100 is worn while still enabling a degree of ventilation for improved wearer comfort.

In exemplary aspects, each of the projections 510 may be formed by mechanically manipulating some or all of the yarns used to form the base material 512. As such, the base material 512 and the projections 510 may comprise a unitary construction from mechanically manipulated yarns. For example, the base material 512 may be knitted in a single jersey pattern, and the projections 510 may comprise French terry Jacquard loops knitted using some or all of the yarns used to knit the base material 512. Other knitting or weaving processes are contemplated herein to form the projections 510. In exemplary aspects, the terminal ends 511 of the projections 510 may be brushed to impart an increased softness or warmth to the projections 510. In other words, by brushing the terminal ends 511 of the projections 510, the surface area of the projections 510 may be increased, and the projections 510 may be better adapted to retain or trap body heat produced by the wearer.

In exemplary aspects, the yarns used to form the base material 512 and the projections 510 may comprise, for instance, polyester yarns, and/or polyester yarns combined with other yarns such as cotton, wool, spandex, and the like. With respect to this aspect, the insulation features provided by the projections 510 may be primarily due to the size and/or surface area of the projections, the brushed terminal ends, the density of the projections, and the like. The yarns used to form the base material 512 and/or the projections 510 may also possess moisture-management characteristics (i.e., the ability of a fabric to move moisture from one surface to an opposite surface through, for instance, capillary action, a denier differential, absorption, and the like). For example, moisture may move from the wearer's body surface, through the projections 510, and to the base material 512.

However, as briefly set forth above, special-purpose yarn and/or fiber types may also be used when forming the base material 512 and the projections 510. One exemplary fiber type is a Far Infra-Red (FIR) fiber. FIR fibers are typically produced by embedding far infra-red-emitting ceramic micro-particles in polypropylene fibers. When utilized in apparel, the ceramic micro-particles absorb body heat produced by the wearer (and/or ambient heat in the environment) and emit harmless far infra-red radiation in the range of, for instance, 4 to 14 microns in wavelength. The emitted radiation is absorbed by the human body where it can produce a thermal or warming effect (via, for instance, exciting water molecules present in the human body). The FIR fibers may be combined with other fiber types (cotton, polyester, and the like) to produce yarns that are utilized when forming the base material 512 and/or projections 510. In exemplary aspects, the amount or percentage of FIR fibers in the yarns may be adjusted to provide greater or lesser degrees of warming. For example, the amount or percentage of FIR fibers in the yarns used to form, for instance, the first and second garment portions 310 and 312 may be greater than the amount or percentage of FIR fibers in the yarns used to form, for instance, the third garment portion 314, as the first and second garment portions 310 and 312 are generally configured to provide a higher degree of insulation than the third garment portion 314.

Another exemplary yarn type is a hollow core yarn. As its name implies, the yarn has a hollow core that is able to trap body heat produced, for instance, by the wearer. In exemplary aspects, the hollow core yarns may be combined (e.g., plaited) with regular yarns such as polyester yarns, cotton yarns, and the like, and/or insulative yarns such as, for instance, wool yarns. Further, in some aspects, the projections 510 may be formed using just the hollow core yarns or a mixture of the hollow core yarns and the regular yarns. Any and all aspects, and any variation thereof, are contemplated as being within the scope herein. Similar to the FIR fibers, the amount or percentage of hollow core yarns may be adjusted to provide greater or lesser degrees of warming. For example, the percentage of hollow core yarns used to form, for instance, the first and second garment portions 310 and 312 may be greater than the percentage of hollow core yarns used to form, for instance, the third garment portion 314 in accordance with aspects herein.

Figure 6:
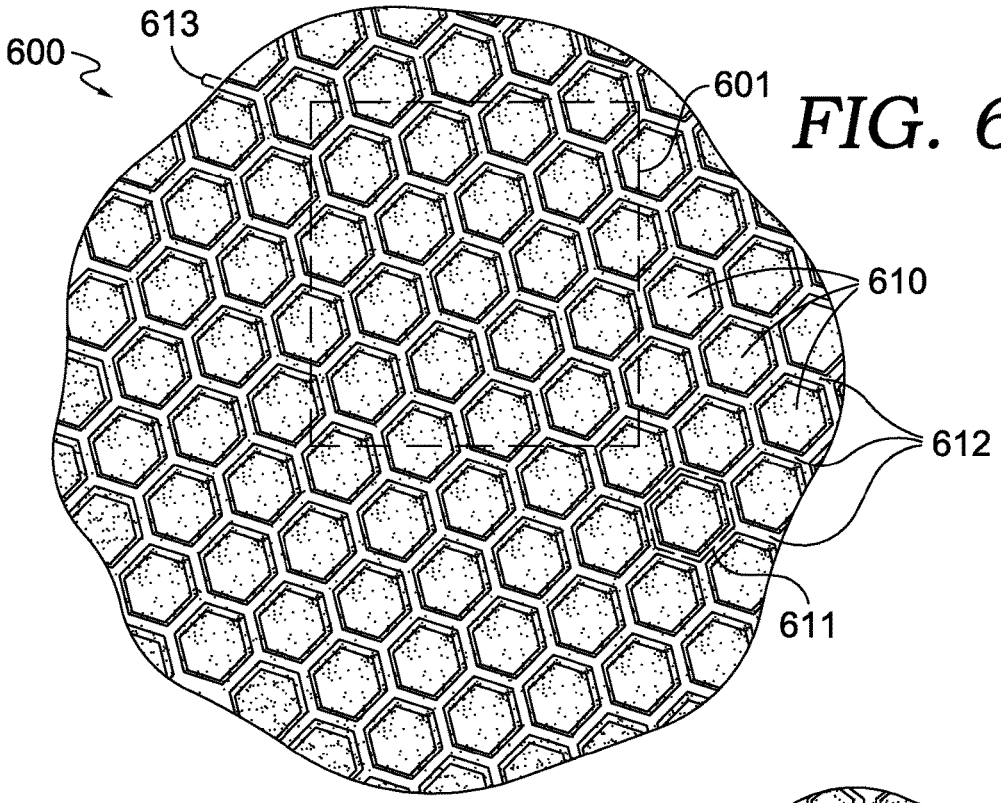
FIG. 6 illustrates a close-up perspective view of a second set of projections in accordance with aspects herein.

Turning now to FIG. 6, referenced generally by the numeral 600, a close-up view of projections 610 utilized in the second garment portion 312 is provided taken at the area indicated in FIG. 3 in accordance with aspects herein. The projections 610 share similar features as the projections 510 associated with the first garment portion 310 but are generally smaller in size. As stated above, the second garment portion 312 may be used to form the first and second sleeve portions 112 and 114.

Similar to the projections 510, the projections 610 extend in the z-direction with respect to the surface plane of the base material (indicated by the reference numeral 612), and each projection 610 may terminate in a terminal end 611 to form a node-like structure. In exemplary aspects, the base material 612 may be the same or different from the base material 512. A cross-section of the projections 610 would be similar to that shown in FIG. 8A except that the size of the projections 814 would be smaller than that shown. As well, the side portions of the projections 610 may be substantially perpendicular to the surface plane of the base material 612, or angled with respect to the base material 612 such that the surface area of the terminal ends 611 may be the same as, greater than, or less than the surface area of the base of the projections 610.

The projections 610 may be arranged in a tessellation pattern and may assume a hexagonal shape although other shape configurations are contemplated herein (e.g., square, rectangle, oval, circle, triangle, and the like). Each projection 610 may have an approximate diameter (measured from one side of the terminal end 611 to an opposing side of the terminal end 611) between, for instance, 5 mm and 15 mm, 7 mm and 12 mm, and/or between 8 mm and 11 mm, although diameters above and below these values are contemplated herein. Each projection 610 may be separated from an adjacent projection 610 by a space 613 The width of the spaces 613 between adjacent projections 610 may be between, for instance, 1 mm and 5 mm, 2 mm and 4 mm, and/or around 3 mm, although widths above and below these values are contemplated herein. As seen, because the diameter of the terminal ends 511 of the projections 510 is greater than the diameter of the terminal ends 611 of the projections 610, each terminal end 511 of the projections 510 may have a greater surface area than each terminal end 611 of the projections 610.

By using smaller-sized projections 610, a greater number of projections per unit area, such as unit area 601, may be achieved as compared to the larger-sized projections 510, where the unit area 501 of FIG. 5 is the same size as the unit area 601. This may, in turn, enable the second garment portion 312 to provide a higher degree of insulation as compared to, for instance, the first garment portion 310 in exemplary aspects. Similar to the spaces 513 discussed with respect to FIG. 5, the spaces 613 may also act as flexion or hinge points such that adjacent projections 610 may flex toward one another or away from each other during movement of the garment 100. Moreover, because the number of projections and spaces 610 and 613 per unit area of the second garment portion 312 is generally greater than the number of projections and spaces 510 and 513 per unit area of the first garment portion 310 due to the smaller size of the projections 610, the second garment portion 312 may exhibit a higher degree of pliability as compared to, for instance, the first garment portion 310. This may be useful to increase flexibility in the first and second sleeve portions 112 and 114 as sleeve portions of a garment typically experience a high degree of flexion, extension, and movement. Further, similar to the first garment portion 310, the spaces 613 in the second garment portion 312 may act as conduits through which air flows when the garment is worn, thereby increasing ventilation and helping to improve wearer comfort.

Similar to the projections 510, each of the projections 610 may be formed by mechanically manipulating some or all of the yarns used to form the base material 612. As such, the base material 612 and the projections 610 may comprise a unitary construction from mechanically manipulated yarns. For example, the base material 612 may be knitted in a single jersey pattern, and the projections 610 may comprise French terry jacquard loops knitted using some or all of the yarns used to knit the base material 612. Other knitting or weaving processes are contemplated herein to form the projections 610. In exemplary aspects, the terminal ends of the projections 610 may be brushed to impart an increased softness or warmth to the projections 610. The yarns used to form the projections 610 may comprise regular and/or insulative yarns (e.g., polyester, cotton, wool, and like) and/or special-purpose yarns such as yarns incorporating FIR fibers and/or hollow core yarns. Any and all aspects, and any variation thereof, are contemplated as being within the scope herein.

Figure 7:
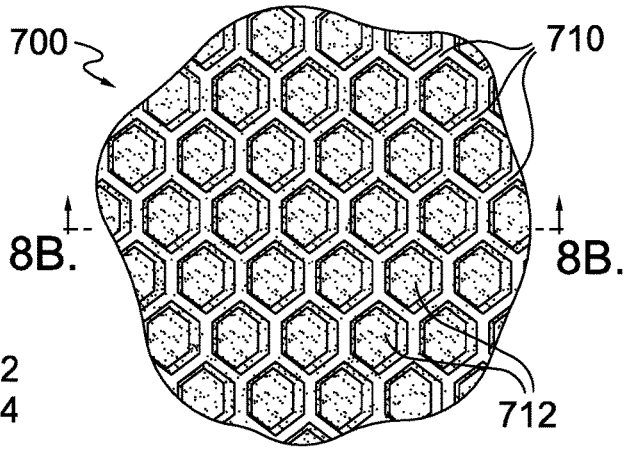
FIG. 7 illustrates a close-up perspective view of a third set of projections in accordance with aspects herein.

FIG. 7, referenced generally by the numeral 700, illustrates a close-up view of projections 710 utilized in the third garment portion 314 taken at the area indicated in FIG. 3 in accordance with aspects herein. Unlike the projections 510 and 610 where the projections terminate in a terminal end to form a node-like structure, the projections 710 terminate in one or more edges which are shown generally en face in FIG. 7. Each projection 710 may comprise a hexagonal shape although other shape configurations are contemplated herein such as square, rectangles, triangles, circles, and the like. The edges of the projections 710 are interconnected to form a honeycomb-like lattice as shown in FIG. 7. Moreover, each projection 710 defines a space 712 comprising the base material. Because each of the projections 710 comprises a hexagonal shape, the spaces 712 also comprise a hexagonal shape.

A cross-sectional view of this configuration is depicted in FIG. 8B, referenced generally by the numeral 850, in accordance with aspects herein. FIG. 8B depicts at least a base material 852 from which a plurality of projections 856, like the projections 710, extend. Each projection 856 terminates in an edge 857. Spaces 858 are formed between adjacent projections 856. In exemplary aspects, the projections 856 may extend substantially perpendicular to the surface plane of the base material 852, or be angled with respect to the surface plane of the base material 852. Any and all aspects, and any variation thereof, are contemplated as being within the scope herein.

Returning to FIG. 7, the edges of each projection 710 may have an approximate width of, for instance, 1 mm to 10 mm, 3 mm to 7 mm, and/or between 4 mm and 6 mm, although widths above and below these values are contemplated herein. The diameter of the spaces 712 as measured from one inner edge of the projection 710 to an opposing inner edge of the projection 710 may be between, for instance, 5 mm to 30 mm, 10 mm to 25 mm, 12 mm to 23 mm, and/or between 14 mm and 20 mm. In exemplary aspects, the surface area of the projections 710 in the third garment portion 314 may be less than the surface area of the spaces 712 defined by the projections 710. To describe it a different way, because the projections 710 do not have terminal ends like the projections 510 and 610, the surface area of the projections 710 is generally less than the surface area of the projections 510 and 610 with respect to a unit area of material.

Similar to the projections 510 and 610, each of the projections 710 may be formed by mechanically manipulating some or all of the yarns used to form the base material. As such, the base material and the projections 710 may comprise a unitary construction from mechanically manipulated yarns. For example, the base material may be knitted in a single jersey pattern, and the projections 710 may comprise French terry jacquard loops knitted using some or all of the yarns used to knit the base material. Other knitting or weaving processes are contemplated herein to form the projections 710. In exemplary aspects, the edges of the projections 710 may be brushed to impart an increased softness or warmth to the projections 710.

The yarns used to form the projections 710 may comprise regular yarns (e.g., polyester, cotton, and like), insulative yarns such as wool, and/or special-purpose yarns such as yarns incorporating FIR fibers, and/or hollow core yarns. As detailed above, since the third garment portion 314 is generally positioned adjacent to the high heat producing back area of the wearer when the garment 100 is worn, in exemplary aspects the percentage of yarns incorporating FIR fibers and/or the percentage of hollow core yarns may be decreased relative to the percentages used in the first and second garment portions 310 and 312. For example, the percentage of special-purpose yarns in the third garment portion 314 may be 90%, 80%, 70%, 60%, 50%, 40%, 30%, 20%, 10%, or 0% of the special-purpose yarns used in the first and second garment portions 310 and 312. Any and all aspects, and any variation thereof, are contemplated as being within the scope herein.

In exemplary aspects, the projections 710 may be used to create stand-off between, for instance, the interior of the garment 100 and the wearer's central back area when the garment 100 is worn. As mentioned, the central back area of a human may comprise a high heat-producing area especially during athletic activities. The stand-off created by the projections 710 may, in exemplary aspects, help to reduce the perception of cling in this area. Further, the stand-off produced by the projections 710 may help to promote the movement of air in this area. Air circulation may be enhanced by the greater percentage of spaces 712 in this area as compared to the projections 710 (i.e., the air can circulate in the spaces 712). The circulating air, in turn, may help to promote evaporative heat transfer and thus, help to cool the wearer.

Figure 9:
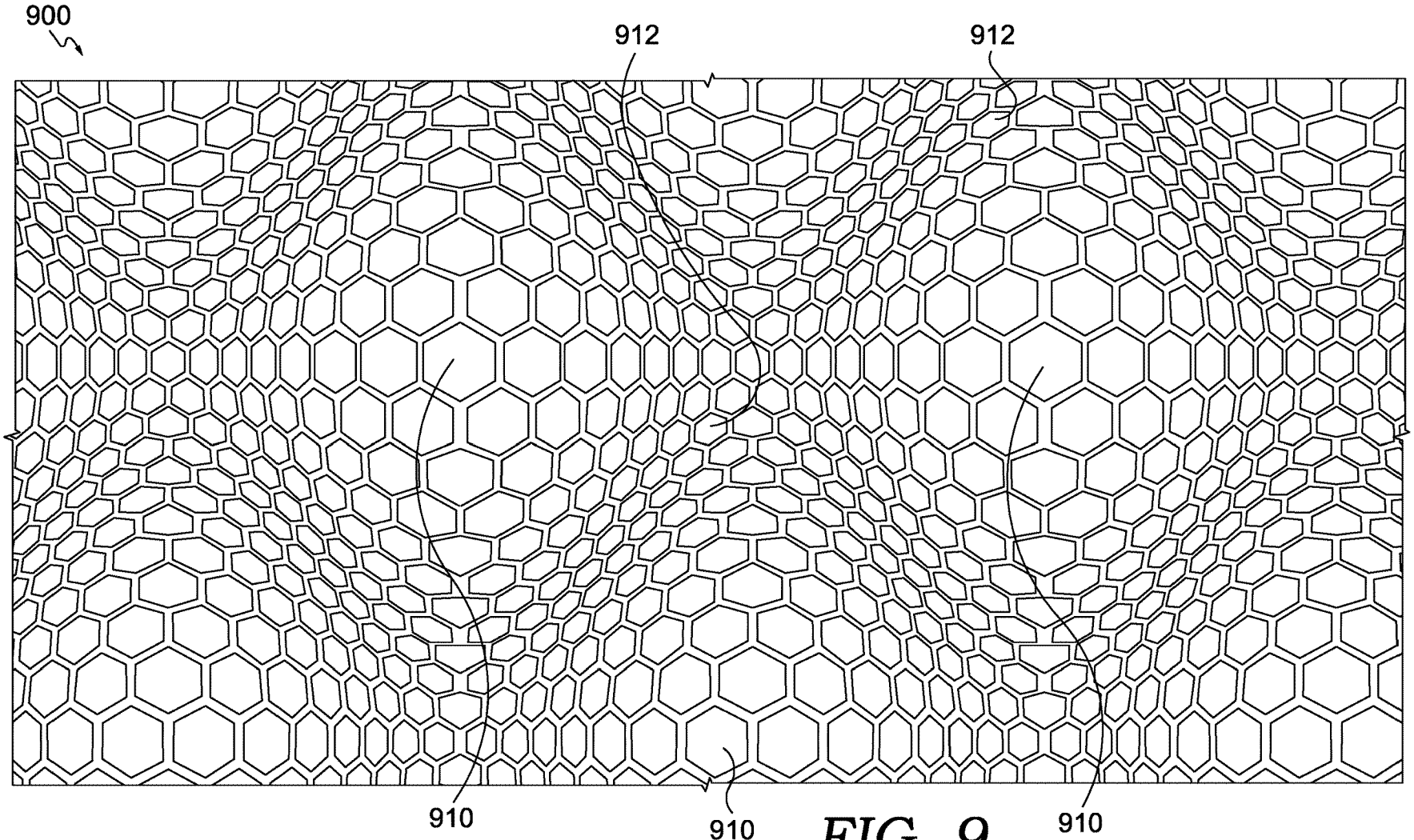
FIG. 9 illustrates an exemplary pattern of projections in accordance with aspects herein.

The pattern of projections shown for the first, second, and third garment portions 310, 312, and 314 is exemplary only and other patterns are contemplated herein. For instance, FIG. 9 depicts an alternative tessellation pattern 900 that may be utilized in accordance with aspects herein. The tessellation pattern 900 consists of an alternating pattern of larger-sized projections 910 transitioning to smaller-sized projections 912 and transitioning back to larger-sized projections 910 in both a horizontal aspect and a vertical aspect. Each of the projections 910 and 912 comprises side portions that extend in the z-direction with respect to the surface plane of the base material and terminal end portions located opposite the base material. Details concerning the projections 910, 912, and 914 such as how they are created, types of yarns/fibers used, shape, spacing, and the like, are similar to those set forth for the projections 510 and 610 and, as such, will not be repeated here.

Figure 10:
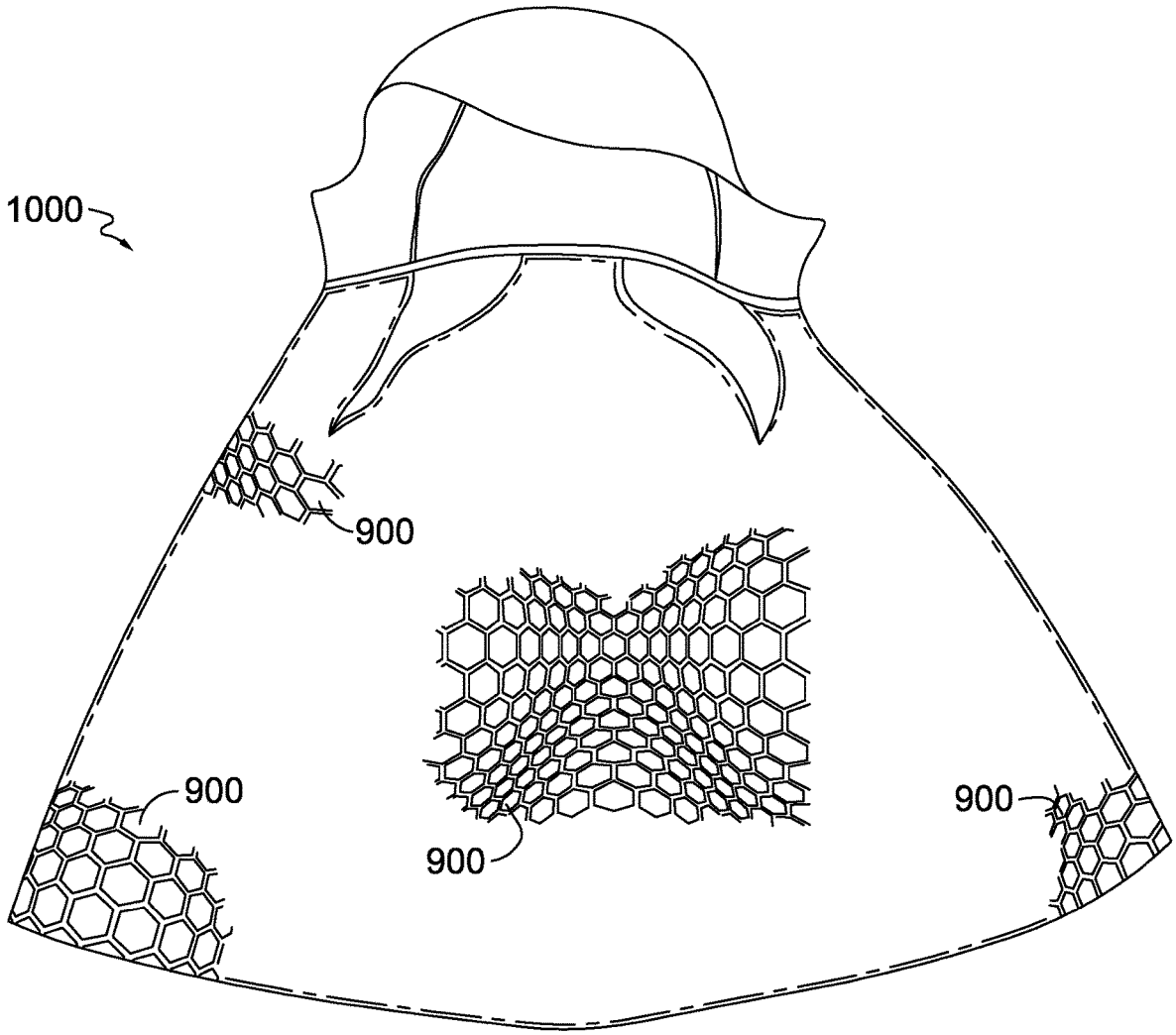
FIG. 10 illustrates an exemplary zoned insulation garment having the exemplary pattern of projections depicted in FIG. 9 in accordance with aspects herein.

FIG. 10 depicts an interior view of an exemplary garment 1000 that incorporates the tessellation pattern 900 depicted in FIG. 9 in accordance with aspects herein. Only a portion of the tessellation pattern 900 is shown. The pattern 900, in exemplary aspects, may be located generally over the back and side portions of the garment 1000 although it is contemplated herein that the pattern 900 may be positioned at other areas of the garment 1000 such as the sleeve portions, the front portions, and the like. In exemplary aspects, the garment 1000 may also incorporate other types of projections such as the projections 510, 610, and/or 710. For instance, the garment 1000 may comprise projections that are similar to the projections 510 of the garment 100. The projections may be located at, for instance, areas of the garment 1000 for which a higher degree of insulation may be needed.

Figure 11:
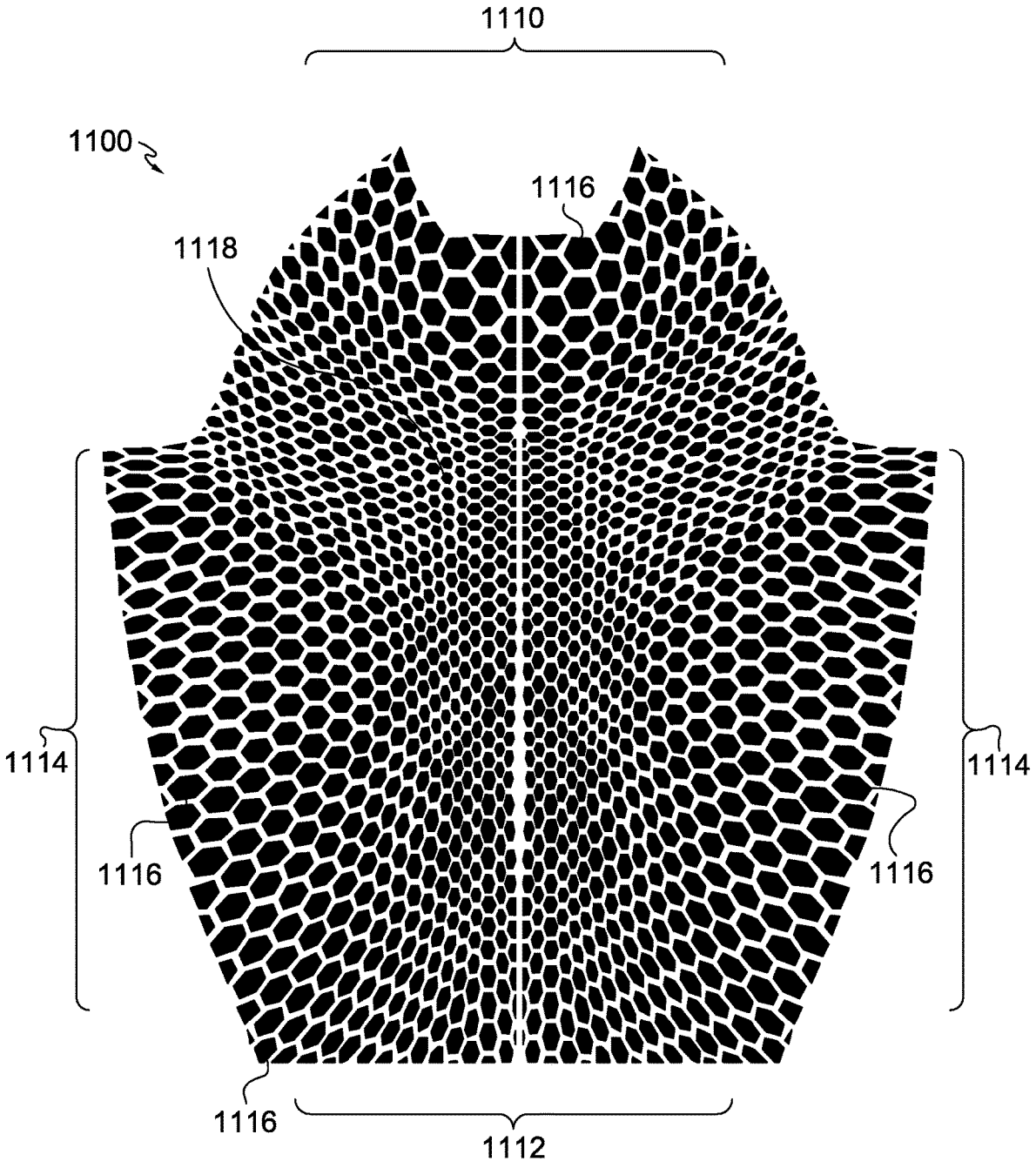
FIG. 11 illustrates an exemplary pattern piece used for an exemplary hood having zoned insulation in accordance with aspects herein.

Turning now to FIG. 11, an exemplary pattern piece for a hood 1100 is provided in accordance with aspects herein. The hood 1100 may be used in association with, for example, the zoned garment 100 and/or the zoned garment 1000. The area indicated by the reference numeral 1110 indicates the portion of the hood 1100 that is adapted to be affixed to the neckline of the garment (hereinafter known as the posterior margin 1110), and the area indicated by the reference numeral 1112 indicates the anterior portion or front edge of the hood 1100 when the hood 1100 is being worn (hereinafter known as the anterior margin 1112). Accordingly, the areas indicated by the reference numeral 1114 indicate side margins of the hood 1100 (hereinafter known as the side margins 1114).

As indicated on the pattern piece for the hood 1100, projections 1116 having a shape and size configuration generally similar to the projections 510 are positioned on the hood 1100 such that they are located generally along the posterior margin 1110, the side margins 1114, and the anterior margin 1112. And projections 1118 having a shape and size configuration generally similar to the projections 610 are positioned at the interior areas of the hood 1100. In other words, the projections 1118 may be bounded by the projections 1116 in exemplary aspects. In exemplary aspects, the density of the projections 1118 per unit area may be greater than the density of the projections 1116 per unit area. As such, in exemplary aspects, the projections 1118 may be adapted to provide a greater degree of insulation than the projections 1116. The configuration of the projections 1116 and 1118 shown in FIG. 11 is exemplary only, and it is contemplated herein that different configurations of projections may be utilized. For instance, the larger-sized projections 1116 may be positioned at the interior portions of the hood 1100 and the smaller-sized projections 1118 may be positioned along the anterior, posterior and side margins of the hood 1100. Moreover, projections, such as the projections 710 may be used in the hood 1100 when lower amounts of insulation and/or increased air flow is desired. As well, different patterns such as the tessellation pattern 900 may be used in association with the hood 1100. Any and all aspects, and any variation thereof, are contemplated as being within aspects herein.

Returning to FIG. 8A, FIG. 8A is an exemplary cross-sectional view, referenced generally by the numeral 800, of the material(s) forming, for instance, the garment 100 and/or the garment 1000 in accordance with aspects herein. As described earlier, at least the interior of the garment described herein may be formed of the base material 812 from which the projections 814 extend. In exemplary aspects, the base material 812 may comprise a single knit jersey, and the projections 814 may comprise French terry Jacquard loops. To provide more structure, in exemplary aspects, a backer material 810 may be utilized such that the backer material 810 is positioned on an external face of the garment when the garment is assembled. In exemplary aspects, the backer material 810 may be affixed to the base material 812 using, for instance, welding, adhesives, thermal bonding, stitching, and the like. In aspects, the backer material 810 may be selectively applied to the base material 812 using for instance, adhesives applied in a dot pattern, spot welding, and the like to increase permeability and/or breathability characteristics of the base material 812/backer material 810 combination. In aspects where the backer material 810 comprises a separate textile that is affixed to the base material 812 to from a composite fabric, the backer material 810 may comprise, for instance, a double jersey fabric or a spacer mesh. Such materials may help to provide structure to the garment while still providing breathability and/or permeability features.

In another exemplary aspect, the backer material 810 may be integrally formed with the base material 812. For instance, the yarns forming the base material 812 may be mechanically manipulated to further form the backer material 810. In one exemplary aspect, the backer material 810 may comprise a drop needle mesh. With respect to this aspect, the drop needle mesh may increase air permeability and breathability (i.e., the ability of a fabric to transport moisture vapor from a first surface of the fabric to an opposite surface of the fabric) of the garment as opposed to some less permeable or breathable backer materials. This may be advantageous in situations where the wearer is participating in athletic activities and producing moisture vapor. When the backer material 810 is integrally formed with the base material 812, special-purpose yarns such as the hollow-core yarns and/or yarns incorporating FIR fibers may be mechanically manipulated to form at least portions of the backer material 810. This may help to increase the insulative characteristics of the garment.

In exemplary aspects, different functional finishes may be applied to the backer material 810. For instance, a durable water repellant may be applied to the backer material 810 to help make the resulting garment substantially impervious to water. FIG. 8B depicts a similar configuration as FIG. 8A. For instance, the base material 852, from which a plurality of projections 856 extend, is secured to a backer material 854. As such, the discussion regarding the backer material 810 of FIG. 8A is equally applicable to the backer material 854 shown in FIG. 8B.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. A zoned insulation upper-body garment comprising:

a torso portion having a front area, a back area, and a pair of side areas;

a pair of sleeves extending from the torso portion;

a first garment portion forming at least the pair of side areas of the torso portion, the first garment portion formed from at least a base material having a first surface and an opposite second surface, wherein a first plurality of projections extend from the first surface of the base material, each of the first plurality of projections having terminal ends located opposite the base material; and a second garment portion forming at least the pair of sleeves, the second garment portion formed from at least the base material, wherein a second plurality of projections extend from the first surface of the base material, each of the second plurality of projections having terminal ends located opposite the base material, wherein an entirety of the terminal ends of the each of the second plurality of projections have a smaller surface area than an entirety of the terminal ends of the each of the first plurality of projections, and wherein there is a greater number of the second plurality of projections per unit area compared to a number of the first plurality of projections per the unit area to provide a higher level of insulation per the unit area than the first plurality of projections.

2. The zoned insulation upper-body garment of claim 1, wherein the first plurality of projections are located adjacent to each other in a tessellation pattern.

3. The zoned insulation upper-body garment of claim 2, wherein spaces are defined between adjacent projections of the first plurality of projections.

4. The zoned insulation upper-body garment of claim 1, wherein the second plurality of projections are located adjacent to each other in a tessellation pattern.

5. The zoned insulation upper-body garment of claim 4, wherein spaces are defined between adjacent projections of the second plurality of projections.

6. The zoned insulation upper-body garment of claim 1, wherein the base material, the first plurality of projections, and the second plurality of projections are formed of unitary construction from mechanically-manipulated yarns.

7. The zoned insulation upper-body garment of claim 1, wherein side portions of each of the first plurality of projections and the second plurality of projections are substantially perpendicular to a surface plane of the base material.

8. The zoned insulation upper-body garment of claim 1, wherein the first plurality of projections and the second plurality of projections comprise a hexagonal shape.

9. A zoned insulation garment comprising:

a first garment portion formed from at least a base material having a first surface and an opposite second surface, wherein a first plurality of projections extend from the first surface of the base material, each of the first plurality of projections having terminal ends located opposite the base material;

a second garment portion formed from at least the base material, wherein a second plurality of projections extend from the first surface of the base material, each of the second plurality of projections having terminal ends located opposite the base material, wherein an entirety of the terminal ends of the each of the first plurality of projections have a greater surface area than an entirety of the terminal ends of the each of the second plurality of projections; and a third garment portion formed from at least the base material, wherein a third plurality of projections extend from the first surface of the base material, each of the third plurality of projections terminating in one or more edges, wherein the each of the third plurality of projections defines a space formed from the first surface of the base material, wherein a surface area of an entire width of the one or more edges of the each of the third plurality of projections is less than a surface area of the space defined by the each of the third plurality of projections.

10. The zoned insulation garment of claim 9, wherein edges of the third plurality of projections are interconnected to one another to form a tessellation pattern.

11. The zoned insulation garment of claim 10, wherein a plurality of spaces are defined by the interconnected edges.

12. The zoned insulation garment of claim 11, wherein the zoned insulation garment comprises at least:

a torso portion having a front area, a back area, and a pair of side areas; and a pair of sleeve portions extending from the torso portion of the zoned insulation garment.

13. The zoned insulation garment of claim 12, wherein the pair of side areas of the torso portion are formed from the first garment portion, wherein the pair of sleeve portions are formed from the second garment portion, and wherein a central back area is formed from the third garment portion.

14. The zoned insulation garment of claim 9, wherein the base material, the first plurality of projections, the second plurality of projections, and the third plurality of projections are formed of unitary construction from mechanically-manipulated yarns.

15. A zoned insulation garment comprising:

a first garment portion formed from at least a base material having a first surface and an opposite second surface, wherein a first plurality of projections extend from the first surface of the base material, each of the first plurality of projections having terminal ends located opposite the base material; and a third garment portion formed from at least the base material, wherein a third plurality of projections extend from the first surface of the base material, each of the third plurality of projections terminating in one or more interconnected edges, wherein the each of the third plurality of projections defines a space formed from the first surface of the base material, wherein a surface area of an entire width of the one or more interconnected edges of the each of the third plurality of projections is less than a surface area of the space defined by the each of the third plurality of projections.

16. The zoned insulation garment of claim 15, wherein the base material, the first plurality of projections, and the third plurality of projections are formed from the same material.

17. The zoned insulation garment of claim 15, wherein the one or more interconnected edges of the third plurality of projections define a plurality of hexagonal spaces.

18. The zoned insulation garment of claim 15, wherein the first plurality of projections have a hexagonal shape.

* * * * *